United States Patent [19]

Sellers

[11] 4,172,445

[45] Oct. 30, 1979

[54] STORAGE TANK HEATER

[76] Inventor: William W. Sellers, The Sellers Company, Inc., 396 E. Church Rd., King of Prussia, Pa. 19406

[21] Appl. No.: 859,878

[22] Filed: Dec. 12, 1977

[51] Int. Cl.[2] ..... E01C 19/45

[52] U.S. Cl. ..... 126/343.5 A; 126/360 R; 126/360 A; 165/135; 431/351

[58] Field of Search ..... 126/343.5 A, 343.5 R, 126/91 A, 360 R, 360 A; 431/351, 353; 165/135, 136

[56] References Cited

U.S. PATENT DOCUMENTS

| | | | |
|---|---|---|---|
| 992,181 | 5/1911 | Foss | 431/351 |
| 1,322,999 | 11/1919 | Bester | 431/351 |
| 1,751,533 | 3/1930 | Taylor | 126/343.5 A |
| 1,798,785 | 3/1931 | Carter | 126/360 A |
| 2,118,479 | 5/1938 | See et al. | 126/360 A |
| 2,593,768 | 4/1952 | Kohn | 126/343.5 A |
| 2,629,366 | 2/1953 | Seevers | 126/343.5 A |
| 2,830,577 | 4/1958 | Walter | 126/343.5 A |
| 3,212,559 | 10/1965 | Williamson | 126/360 A |
| 3,266,485 | 8/1966 | Girton | 126/360 R |
| 3,804,079 | 4/1974 | Schrader | 126/343.5 A |

*Primary Examiner*—Samuel Scott
*Assistant Examiner*—Daniel J. O'Connor
*Attorney, Agent, or Firm*—Harding, Earley & Follmer

[57] ABSTRACT

A tank heater for a storage tank is provided with a fuel fired burner assembly, a heat transfer tube extending from the burner assembly a substantial longitudinal extent within the storage tank for the transfer of heat to the contents of the storage tank and a combustion chamber within the heat transfer tube adjacent the burner assembly, the combustion chamber being constructed in the form of a plurality of concentric tubes in a configuration to control the rate of heat dissipation.

13 Claims, 2 Drawing Figures

STORAGE TANK HEATER

BACKGROUND AND SUMMARY OF THE INVENTION

This invention relates generally to storage tank heaters and, more particularly, to fuel fired heaters for tanks for the storage of fluids such as asphalt (i.e. bituminous material) or hot water.

The fuel fired tank heaters of the indicated type in general use today comprise a burner which is similar to a domestic oil burner and is fitted to a flue containing a ceramic combustion chamber. The ceramic combustion chamber has a rather thick wall and serves to shield the outside of the flue from overheating the asphalt for the length of the ceramic chamber.

It is important from an efficiency standpoint to permit as much of the transfer tube to be heated to the near optimum temperature for heat transfer without overheating. Overheating of the heating surface will cause many undesirable effects on the product such as separation of mixtures and emulsions, distillation of product, coking, changes in viscosity and characteristics of the material in storage as well as deterioration of the heating surface itself, such as pitting and corrosion.

It is the general object of this invention to provide a novel combustion chamber construction for use in the tank heaters of the indicated type which is a substantial improvement over the ceramic combustion chambers of the prior art. To this end, the combustion chamber in accordance with the invention comprises a plurality of tubes arranged one within another and spaced apart radially for control of the dissipation of the heat transferring radially from the combustion products to the exterior of the heat transfer tube in contact with the contents of the tank. This design controls the rate of dissipation of heat primarily by radiation of heat from one tube to another, then to the exterior of the heat transfer tube. By varying the number of tubes, the air gap between tubes, the length of tubes, the concentricity of the tubes, the temperature profile along the length and around the circumference of the heat transfer tube can be designed to correspond to the heat being released by combustion to equalize and balance the heat density to eliminate hot spots and irregularities found in similar equipment of the prior art.

Another significant advantage of the tube within a tube design of the invention results from the fact that this design involves much less mass than comparable ceramic tube combustion chambers and the ceramic tubes may be made of metal, such as steel, which had a very low specific heat as compared with the ceramic material used in the prior art combustion chamber. Thus, the combustion chamber will come up to efficient operating temperature more rapidly and after a long period of operation, there will be a very minimal temperature override with the tank heater in accordance with the invention as compared to a considerable temperature override which is caused by the hot ceramic used in the prior art designs which ceramic continues to give off heat over an extended period after the burner has been turned off.

Another advantage of the design in accordance with the invention is that it is less costly to manufacture than a comparable ceramic combustion chamber design. Also, the design permits the use of a smaller size primary flue in the combustion chamber area since the tube within a tube assembly occupies less space than a comparable design, reducing the amount of liquid in the tank required to cover the heating system making available more material for use and less in dead storage. Accordingly, a smaller size fire box for the burner may be used, again resulting in a savings of cost and a more efficient consumption of fuel.

Another feature of the inventive design is that by constructing the tubes of metal the unit is not subject to damage in shipment as is the case with the prior art ceramic insulator design.

This invention also permits air to be introduced between one or more of the tubes either by the eductor effect of the combustion gases passing through the transfer tube or by positive means to further control the surface temperature of the heating surface in contact with the product.

DESCRIPTION OF THE PREFERRED EMBODIMENT OF THE INVENTION

Figure 1:
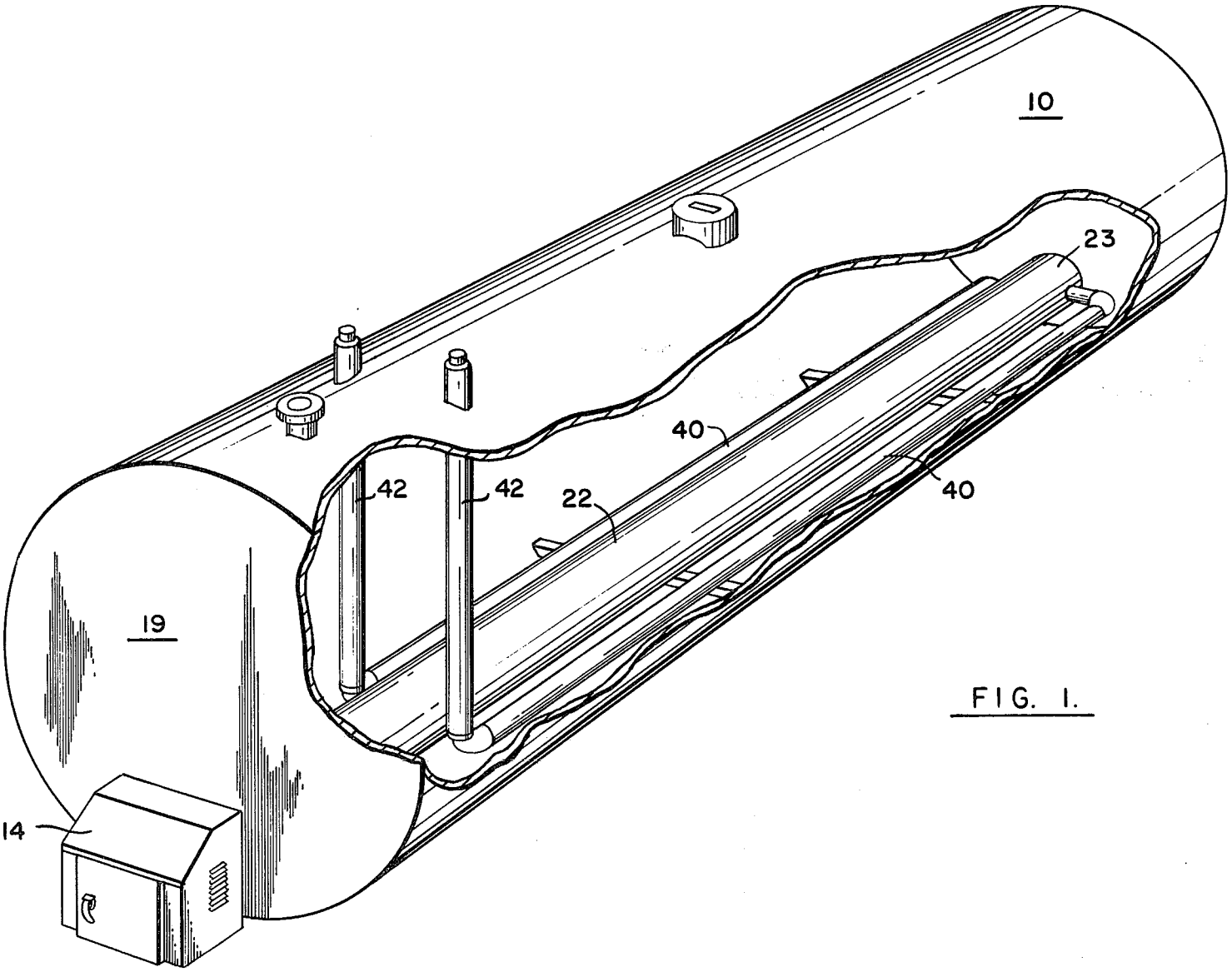
FIG. 1 is a perspective view of a storage tank heater in accordance with the invention.

The invention will be described as applied to the storage heater shown in the drawings which is designed for continuous operation is asphalt plant service. It is to be noted that the invention is more generally applicable to storage tank heaters for various fluids such as water.

The storage tank heater in accordance with the invention is adapted to extend horizontally along the bottom of an insulated cylindrical storage tank 10 as shown in FIG. 1 and comprises an oil fired burner assembly 12 contained in a weatherproof burner and control housing 14. The burner assembly 12 is similar to a conventional domestic oil burner and includes a blower for delivering ignited fuel at a substantial velocity through a discharge 16 into a combustion chamber 20 located adjacent to the discharge 16. The discharge 16 extends through a block 18 of insulating material in the tankhead 19 of the tank 10. As is shown in FIG. 2, the combustion chamber 20 extends a substantial distance from the discharge 16 into a primary heat transfer tube 22.

The primary heat transfer tube 22 of a cylindrical construction extends through a circular opening 17 in the tankhead 19 horizontally along the bottom of the tank 10. The tube 22 receives heating gases from the combustion chamber 20 and directs them along the bottom of the tank 10 for heating the contents of the tank 10.

In accordance with the invention, there is provided a novel design for the combustion chamber 20. To this end, the combustion chamber 20 comprises three concentric cylindrical tubes arranged one within another, namely, inner tube 24, intermediate tube 26, and outer tube 28. Like the tube 22, the tubes 24, 26 and 28 are mounted at one end on an end plate 30. In the preferred design, the tubes 24, 26 and 28 are concentric and are spaced apart radially equally to provide an annular space 32 between inner tube 24 and intermediate tube 26 and an annular space 34 between intermediate tube 26 and outer tube 28, as is apparent from FIG. 2. Also, the outer tube 28 is spaced radially from the primary heat transfer tube 22 to provide an annular air space 36. The air spaces 32, 34 and 36 have approximately the same radial thickness.

Figure 2:
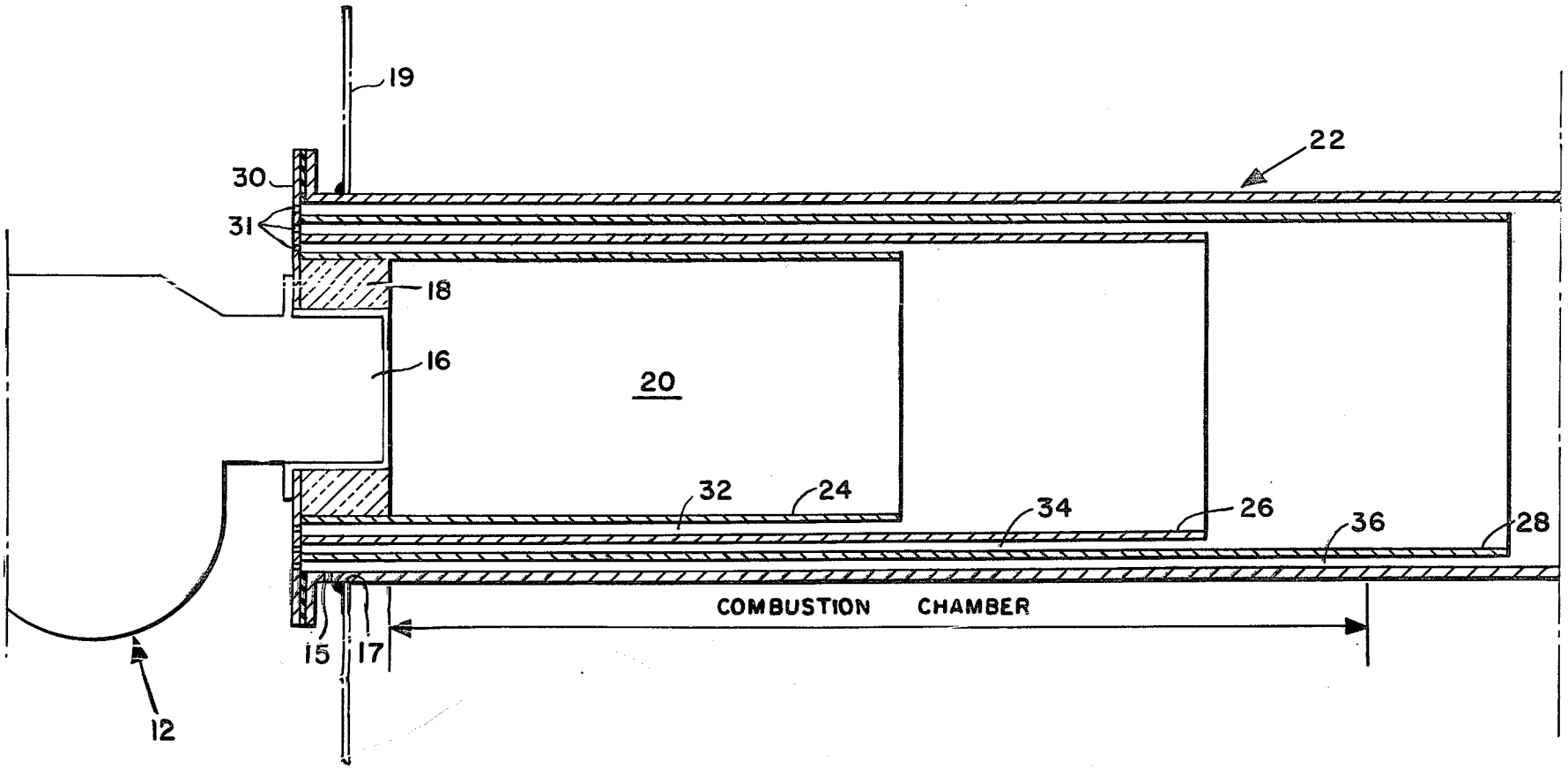
FIG. 2 is a detail view of the combustion chamber portion of the storage tank heater shown in FIG. 1.

As is apparent from FIG. 2, the intermediate tube 26 is longer than the inner tube 24 and the outer tube 28 is longer than the intermediate tube 26 by approximately the same amount. Accordingly, air spaces 32, 34 and 36 extend longitudinally greater distances, respectively. The manner in which the above-described combustion chamber design controls the rate of dissipation will be described in detail hereafter in connection with the description of the operation of the storage tank heater of the invention.

The primary heat transfer tube 22 is supported on longitudinally spaced angle irons to extend horizontally along the bottom of the tank 10 throughout the longitudinal extent thereof as is apparent from FIG. 1. The tank heater includes a pair of secondary heat transfer tubes 49 which extend from the end 23 of the primary heat transfer tube 22 toward the tankhead 19 in spaced parallel relation with respect to the primary heat transfer tube 22. The tubes 40 terminate at vertical stacks 42 which extend upwardly through the top of the storage tank 10 as is shown in FIG. 1. The secondary heat transfer tubes 40 direct heating gases from the end 23 of the primary heat transfer tube 22 along the bottom of the tank 10 to the vertical stacks 42 in which the gases flow upwardly to the exterior of the storage tank 10.

In the operation of the storage tank heater in accordance with the invention, the burner assembly 12 delivers ignited fuel at a substantial velocity through the discharge 16 into the combustion chamber 20 whereat the fuel burns. Heating gases flow horizontally from the combustion chamber 20 through the primary heat transfer tube 22 to the end 23 from which the heating gases flow horizontally through secondary heat transfer tubes 40 and upwardly through the stacks 42 to the exterior of the tank 10. The tubes 22 and 40 transfer heat to the contents of the tank to maintain a desired temperature of these contents by the use of appropriate temperature controls (not shown).

The combustion chamber design in accordance with the invention, comprising the three concentric tubes 22, 24 and 26 defining concentric air spaces 32, 34 an 36, controls the rate of heat dissipation from the combustion products in the combustion chamber 20 to the portion of the primary heat transfer tube 22 surrounding the combustion chamber 20 in a manner to equalize and balance the heat density to eliminate hot spots in this region. This is achieved by the action whereby the rate of heat transfer is retarded to a greater extent in the regions closer to the discharge 16. Thus, heat travelling radially outwardly from within the tube 24 must pass through three air spaces 32, 34 and 36, heat travelling radially outwardly from within the portion of tube 26 downstream of the end of tube 24 must pass through two air spaces 34 and 36, and heat travelling radially outwardly from within the portion of tube 28 downstream of the end of tube 26 flows radially outwardly through one air space 36. Accordingly, there is a greater amount of heat dissipation in each of the regions as you move closer to the discharge 16. This arrangement serves to equalize the temperature at the exterior of the heat transfer tube 22 along the length thereof in the region of the combustion chamber 20. Moreover, by reason of this control of the heat dissipation in the region of the combustion chamber, there is provided a more uniform heat profile along the length of the heat transfer tube 22 and the area of the heat transfer tube 22 used for heating is extended.

Optionally, there may be provided passage means providing flow communication between the exterior of the tank and air spaces 32, 34 and 36. The passage means may be provided, for example, by a plurality of circumferentially arranged holes 31 in end plate 30 as is shown in FIG. 2. These holes 31 permit air to be introduced into selected air spaces by the eductor effect of the combustion gases passing through the transfer tube 22. Also, there may be provided positive means to introduce air through holes 31 in selected air spaces to further control the surface temperature of the heating surfaces in contact with the product.

A hole 15 may be provided in the bottom of tube 22 between the tank wall 19 and end plate 30 as is shown in FIG. 2. Hole 15 serves several purposes, namely, to permit the entrance of air, to act as a drain for any water that might enter the exhaust flue while the equipment is not in operation, and to act as a "telltale" or indicator if a leak develops in the flue system, which leak could be detected by leakage out of hole 15 before the entire flue was filled with material.

It will be apparent that various changes may be made in the construction and arrangement of parts without departing from the scope of the invention. For example, while tubes 24, 26 and 28 are preferably arranged concentrically, they may be arranged eccentrically or in a combination of eccentric and concentric tubes in accordance with the broadest aspects of the invention. Also, various tube length relationships may be employed. For example, the intermediate tube may be the longest and all the tubes may be of the same length. While these possible modifications within the broadest scope of the invention would not give the uniform performance that can be achieved with the tubes of varying length as described in accordance with the preferred embodiment of the invention, they would have advantages over the prior art all ceramic fire box chamber.

I claim:

1. A heater for a storage tank for fluids comprising:

a fuel fired burner assembly, a heat transfer tube extending from said burner assembly a substantial longitudinal extent within the storage tank for the transfer of heat to fluid within the storage tank, and means providing a combustion chamber within said heat transfer tube at a location adjacent said burner assembly, said burner assembly being arranged to direct a stream of combustion products into said combustion chamber, said combustion chamber providing means including a plurality of tubes arranged one within another and having portions spaced apart radially for the dissipation of heat transferring radially from combustion products within said combustion chamber to the exterior of said heat transfer tube wherein said plurality of tubes comprise at least an inner tube of a first length and at least an outer tube of a length greater than said inner tube, each of said tubes extending longitudinally from the end of said combustion chamber receiving the combustion products from said burner assembly for avoiding overheating of said heat transfer tube at the region thereof near the burner assembly.

2. A heater according to claim 1 wherein said plurality of tubes are of different lengths.

3. A heater according to claim 1 wherein said plurality of tubes are arranged concentrically and include an intermediate tube of a length greater than said inner tube and less than said outer tube.

4. A heater according to claim 2 wherein one or more of said tubes is made of metal resistant to high temperature.

5. A heater according to claim 2 wherein one or more of said tubes is made of a high temperature ceramic or other non-metallic material.

6. A heater according to claim 2 wherein said tubes are thin-walled and are arranged concentrically.

7. A heater according to claim 2 including at least one secondary heat transfer tube extending along side of said first-mentioned heat transfer tube and communicating therewith for directing the flow of heating gases within the storage tank.

8. A heater according to claim 7 wherein said heat transfer tubes extend horizontally along the bottom of the storage tank and including a vertically extending stack for directing the flow of heating gases from said secondary heat transfer tube to the exterior of the storage tank.

9. A heater according to claim 8 wherein said tubes arranged one within another are made of a thin-walled metal and are concentrically arranged.

10. A heater according to claim 8 wherein said tubes arranged one within another are made of a thin-walled high temperature ceramic or other non-metallic material.

11. A heater according to claim 2 including passage means for introducing air between said spaced tubes.

12. A heater according to claim 2 wherein the liquid in the tank being heated is a bituminous material.

13. A heater according to claim 2 wherein the spaces between said spaced tubes are closed at the ends thereof adjacent said burner assembly to prevent the introduction of air therein.

* * * * *